United States Patent [19]

Smith

[11] 4,411,096

[45] Oct. 25, 1983

[54] EDUCATIONAL TOY DOLL WITH WEIGHT TENDING TO RETURN HEAD

[76] Inventor: Samuel C. Smith, 210 Hartman Rd., Newton Centre, Mass. 02159

[21] Appl. No.: 351,114

[22] Filed: Feb. 22, 1982

[51] Int. Cl.[3] ..... A63H 15/06

[52] U.S. Cl. ..... 46/155; 46/164

[58] Field of Search ..... 46/135 R, 155, 164, 46/167, 142, 143; 272/77

[56] References Cited

U.S. PATENT DOCUMENTS

| | | | |
|---|---|---|---|
| 1,394,669 | 10/1921 | DaCosta | 46/155 |
| 2,499,743 | 3/1950 | Goodman | 46/155 |
| 2,571,275 | 10/1951 | Meaker | 46/155 |
| 2,577,343 | 12/1951 | Martin | 46/155 |
| 3,442,045 | 5/1969 | Green | 46/155 |

FOREIGN PATENT DOCUMENTS

| | | | |
|---|---|---|---|
| 2800446 | 7/1979 | Fed. Rep. of Germany | 46/155 |

*Primary Examiner*—Richard T. Stouffer
*Assistant Examiner*—William H. Honaker
*Attorney, Agent, or Firm*—Maurice R. Boiteau

[57] ABSTRACT

There is disclosed in the present application a toy in the form of a doll or statue representing a human figure, including a body and a head which is completely separable from the body. The head is contoured and balanced in such a way that when displaced downwardly from its normal at rest position atop the body, it rolls back upwardly to its normal position, seemingly in defiance of gravity. The movement of the head toward its normal position is accomplished by one or more weights embedded in the head, which provide the necessary torque to cause it to move upwardly to its position on the shoulders.

8 Claims, 4 Drawing Figures

EDUCATIONAL TOY DOLL WITH WEIGHT TENDING TO RETURN HEAD

The present invention relates generally to toys but more particularly to toy dolls or statues which have an educational character by presenting a viewer with operation seemingly contradicting well known and accepted physical principles.

One manner in which a toy, game or exhibit provides an educational stimulus is by creating a situation which motivates the viewer to seek an explanation for an observation apparently inconsistent with what he knows to be factual. Such a stimulus is presented, for example, when an observer is exposed to an object which moves uphill, unaided externally and seemingly in direct opposition to the pull of gravity. The natural tendency of the viewer under these circumstances is to attempt to explain the phenomenon, first, by inquiring whether the motion is accomplished by the attraction of hidden magnets or through some other unseen connection. When the more obvious possibilities fail to explain the motion, the viewer is prepared to consider in detail less obvious but more appropriate bases for the observed motion.

It is accordingly an object of the present invention to stimulate the inquiry by a viewer into the explanation for demonstrated motion which is seemingly inconsistent with known physical principles.

A more general object is to stimulate interest by viewers, especially the young, into a broader understanding of scientific principles.

An even more general object is to provide enjoyment for the witness of a demonstration.

The foregoing objects are achieved in accordance with the present invention by a doll or statue which, typically though not necessarily representing a human figure and including a demonstrably separable head and a body at least partially erect and providing a normal, at rest position for the head on its shoulders. According to a feature of the invention, the body is shaped to present one or more guideways inclined downwardly on the shoulders from the normal head position. In accordance with a related feature, the head, which has a circular cross-section, either cylindrical or spherical, is internally weighted in such a manner that a rolling displacement of the head downwardly from its normal position results in a torque which causes the head to roll up the incline to its normal at rest position.

The foregoing objects and features, together with numerous advantages of the present invention, will be better understood from the following detailed description of illustrative embodiments taken in connection with the accompanying drawings in which.

Figure 1:
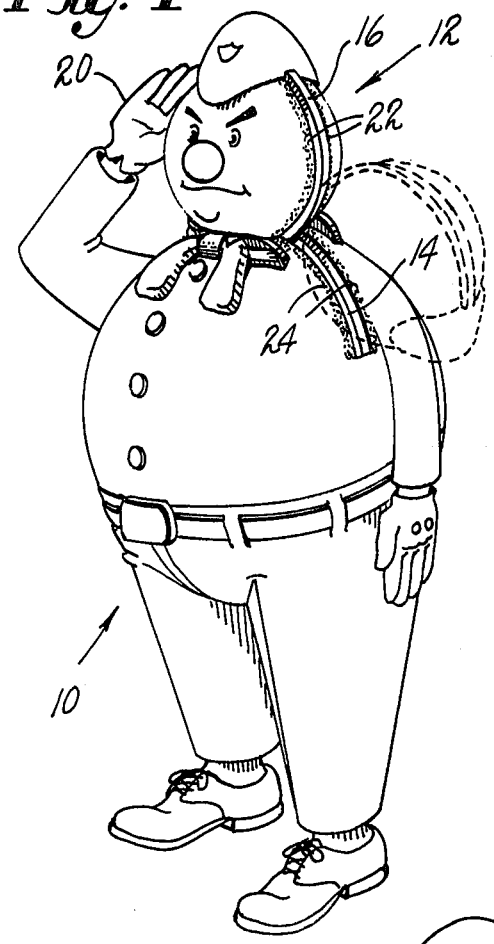
FIG. 1 is a view in perspective as seen from the right front of a doll figure including a body and a separable head according to the present invention.
Figure 2:
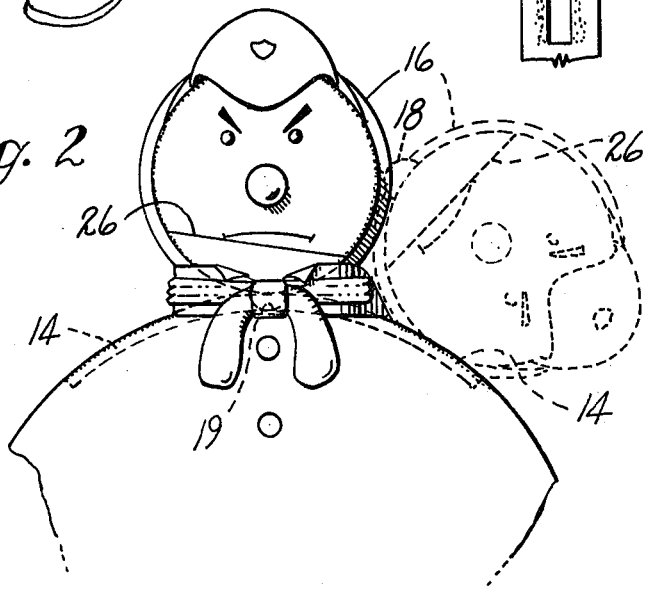
FIG. 2 is a partial view in front elevation and on an enlarged scale depicting the upper portion of the doll shown in FIG. 1 and illustrating limits of positions which may be occupied by the head.

Turning now to the drawings, particularly FIGS. 1 and 2, there is shown a doll toy figure according to the present invention and including a body indicated generally at 10 and a head indicated generally at 12. The upper portion of the body is generally rounded and formed with an open slot 14 which may extend on both shoulders as seen in FIG. 2, and in which is loosely received a guiding peripheral rib 16 on the head 12. In addition, the head 12 is formed with a rounded projection 18 adapted to be received in a suitable socket 19 in the top of the body. It will thus be appreciated that an at rest position of the head 12 and the angular orientation of the head in that position are determined by the entry of the projection 18 into the socket 19 and further that motion of the head in a counter-clockwise direction, as seen in FIG. 1, is limited by the hand 20. The clockwise motion of the head 12 away from its normal at rest position is limited by the closed end of the slot 14. A slight variation is shown in FIG. 2 in that the slot 16 extends in both directions and the head 16 is thus free to move in either direction from the at rest position and its travel is confined by the closed ends of the slot.

It has already been pointed out that the head 12 is completely separable from the body 10 and also that it is so constructed and balanced that when rolled on the body to a position displaced from its normal one atop the body, rolls upwardly, apparently defying the laws of gravity toward the normal position, where it remains at rest. In order that the head 12 will roll rather than slide in contact with the body 10, a frictional material such as extended rubber sheet is affixed to the head and/or body adjacent the rib 16 and slot 14. Alternatively, a portion of the head and body may be appropriately texture to limit slippage. Torque for returning the head 12 to its normal at rest position atop the shoulders, is supplied by a weight 26 on the interior of the head which is hollow and of relatively light weight construction. The weight 26 is effectively concealed either by making the head of an opaque material or by shielding the front and rear surfaces of the head with opaque sheets on which features of the head are depicted. Alternatively, the weight 26 may be in the form of lead shot inserted into openings in the base of the head 12.

Figure 3:
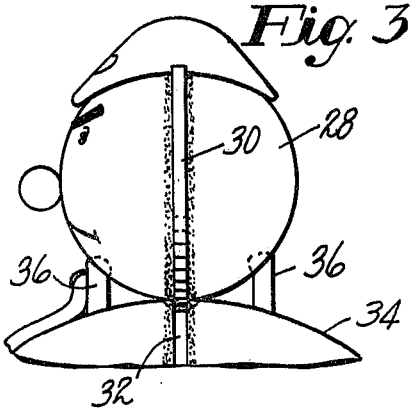
FIGS. 3 and 4 are fragmentary views in side elevation alternative embodiments of the invention.

A variation shown in FIG. 3 includes a spherical head 28 also formed with a peripheral guiding rib 30 which loosely engages a slot 32 in a body 34. For a more natural appearance, the body 34, as well as the head 28, is formed with greater thickness, its shape approaching a sphere. In order to confine the head 28, guide ramps 36 disguised as part of a collar are provided on the body 34. As in the case of embodiments depicted in FIGS. 1 and 2, the lateral movement of the head 28 is limited by making both extremities of the slot 32 close ended.

Figure 4:
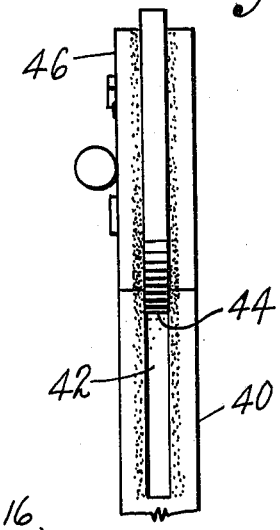

A less expensive version of the invention is shown in FIG. 4 and includes a relatively flat body 40 formed with a guide slot 42 adapted to be loosely entered by a peripheral rib 44 on an equally flat head 46. As in the priorly described embodiments, the head 46 is weighted and balanced for upward rolling travel on the shoulders of the body and the lateral displacement of the head is limited by a close ended slot in both directions.

From the above description of illustrative embodiments, many variations will become readily apparent to those of ordinary skill in the toy and puzzle art. For example, although the drawings and description have been directed to figures of human appearance, it will be readily understood that the figures could be those of animals, either upright such as monkeys, bears and pandas or in reclining positions, so long as properly oriented surfaces and shapes are provided. It is accordingly not intended that the foregoing description and drawings be taken in a limiting sense but rather that the scope of the invention be interpreted from the appended claims.

Having thus described my invention, what I claim as new and desire to secure by Letters Patent of the United States is:

1. An educational toy comprising a body having at least a generally erect portion, an elongated guideway extending downwardly on the body from the top of the generally erect portion, a head of generally circular cross-section separably mounted on the body and directed by the guideway, said head including a peripheral rib engaging said guideway, means for angularly orienting the head in a normal at rest position on top of the generally erect portion and means including a weight positioned in the head for supplying a torque tending to return the head to its at rest position after it has been rotated downwardly along the guideway.

2. An educational toy according to claim 1 further characterized in that the body is a generally erect body formed with downwardly extending shoulders and head orienting means between the shoulders.

3. An educational toy according to claim 2 further characterized in that the guideway includes a slot extending down at least one of the shoulders.

4. An educational toy according to claim 1 further comprising means adjacent the guideway for preventing slippage between the head and body as the head is displaced laterally from its normal at rest position.

5. An educational toy according to claim 3 further comprising means adjacent the guideway for preventing slippage between the head and body as the head is rotated downwardly along the guideway from its at rest position.

6. An educational toy according to claim 1 further comprising means for limiting movement of the head down the guideway.

7. An educational toy according to claim 2 further characterized in that the guideway comprises a slot in at least one of the shoulders and further comprising means for limiting downward movement of the head on the shoulder.

8. An educational toy according to claim 3 further comprising means for limiting downward movement of the head including a closed end to the slot.

* * * * *